US005404860A

United States Patent [19]

Morino

[11] Patent Number: 5,404,860

[45] Date of Patent: Apr. 11, 1995

[54] IGNITION SYSTEM FOR INTERNAL COMBUSTION ENGINE

[75] Inventor: Seiji Morino, Okazaki, Japan

[73] Assignee: Nippondenso Co., Ltd., Kariya, Japan

[21] Appl. No.: 131,737

[22] Filed: Oct. 5, 1993

[30] Foreign Application Priority Data

Oct. 6, 1992 [JP] Japan ..... 4-267495

[51] Int. Cl.[6] ..... F02P 3/06

[52] U.S. Cl. ..... 123/605; 123/634

[58] Field of Search ..... 123/605, 634, 636, 621, 123/620

[56] References Cited

U.S. PATENT DOCUMENTS

| | | | |
|---|---|---|---|
| 4,462,380 | 7/1984 | Asik | 123/621 |
| 4,478,201 | 10/1984 | Asik | 123/620 |
| 4,892,080 | 1/1990 | Morino et al. | 123/604 |
| 5,056,496 | 10/1991 | Morino et al. | 123/604 |
| 5,193,515 | 3/1993 | Oota et al. | 123/637 |
| 5,211,152 | 5/1993 | Alexandrov | 123/620 |
| 5,220,901 | 6/1993 | Morita et al. | 123/620 |
| 5,228,425 | 7/1993 | Simons | 123/620 |
| 5,261,381 | 11/1993 | Sugiura et al. | 123/634 |
| 5,315,982 | 5/1994 | Ward et al. | 123/605 |

FOREIGN PATENT DOCUMENTS

| | | |
|---|---|---|
| 50-28281 | 8/1975 | Japan . |
| 01232165 | 9/1989 | Japan . |

OTHER PUBLICATIONS

Journal of Nippondenso Technical Disclosure 34–61, Mar. 15, 1984.

Journal of Nippondenso Technical Disclosure 82–103, Jan. 15, 1992.

*Primary Examiner*—Andrew M. Dolinar

*Assistant Examiner*—Thomas N. Moulis

*Attorney, Agent, or Firm*—Cushman, Darby & Cushman

[57] ABSTRACT

An ignition system of an internal combustion engine for simultaneously exciting pairs of spark plugs, which system includes direct current circuits connecting in series primary windings of ignition coils having a coupling coefficient of higher than or equal to 0.9 and connected to spark plugs of engine cylinders working in pairs, one cylinder in a compression stroke while the other in an exhaust stroke, MOSFETs at one ends of the circuits, and an energy accumulating portion including a capacitor and a wiring coil, wherein the MOSFET turns on at an exciting timing for the corresponding cylinder to excite the corresponding direct current circuit by excitation energy accumulated in the energy accumulating portion in order to produce sparks in paired spark plugs, resulting in reliable firing of air/fuel mixture in engine cylinders in compression stroke in a short period and small energy of current in the windings.

3 Claims, 4 Drawing Sheets

POWER SOURCE CIRCUIT
DRIVER CIRCUIT
DISTRIBUTION CIRCUIT
DRIVER CIRCUIT
DWELL ANGLE CONSTANT CURRENT CONTROL
DELAY CIRCUIT
ECU
F-V CONVERTER
IGt
IGd
IGd
Co
Lo
TR1
TR2
TR3
S
R
Q
Va
Vb
1
2
3
4
11
12
13
14
16
16a
18
18a
20
30
32
40
50
52
54
56
58
60
70
80
90
100

IGNITION SYSTEM FOR INTERNAL COMBUSTION ENGINE

BACKGROUND OF THE INVENTION

1. Field of the Invention

The present invention relates to an ignition system for an internal combustion engine, more particularly, to an ignition system for an internal combustion engine of so-called two cylinder simultaneous ignition type, in which a plurality of ignition coils are connected to respective spark plugs in respective engine cylinders and, among the ignition coils, primary windings of two ignition coils connected to the spark plugs of the cylinders working in pairs in compression stroke and exhaust stroke, are connected in series for simultaneous exciting the primary windings.

2. Description of the Related Art

Conventionally, there have been known ignition systems, in which high tension cords are eliminated by connecting each spark plug in the internal combustion engine to the ignition coil directly, and number of switching elements or power transistors for excitation control is reduced to be a half of number of cylinders of the internal combustion engine by connecting in series the primary windings connected to the spark plugs of two cylinders which are correlated in timing so that one is in the compression stroke while the other is in the exhaust stroke, for simultaneous excitation. (See Journal of Nippondenso Technical Disclosure 34–61, 82–103).

The foregoing ignition system is a so-called inductive discharge type ignition system which flows current through the primary windings of two ignition coils by directly applying power source voltage or battery voltage and produces sparks through the spark plugs by a high voltage generated on secondary windings upon shutting off of the current. Because two primary windings are connected in series, the excitation period for the primary windings to obtain a given excitation current for generating the high voltage at the secondary winding sufficient for ignition, becomes substantially double of the case where the primary winding for a single ignition coil is to be excited. Therefore, in the above-mentioned ignition system, a problem is encountered in that the voltage to be generated in the secondary winding is significantly lowered in a high speed range of the internal combustion engine where the available period gets short for excitation of the primary winding.

Also, when the primary windings of two spark plugs are excited simultaneously, a problem may be encountered in that since an ignition energy is accumulated in the ignition coil for discharging, the necessary energy for exciting two primary windings becomes double of the case where a single winding of the ignition coil is to be excited.

On the other hand, a system for simultaneously exciting primary windings of two ignition coils which are connected in series for simultaneously sparking two spark plugs, is disclosed in Japanese Examined Utility Model Publication JP-Y-50-28281, for example. Therefore, an ignition system of a so-called capacitive discharge type is also known, in which a high voltage is preliminarily charged in a capacitor before exciting the ignition coils and the primary winding is excited with the high voltage charged in the capacitor at a given ignition timing.

This ignition system is a system for simultaneously charging an igniting high voltage for two spark plugs in a single cylinder. Such capacitive discharge type system instantly generates the high voltage on the secondary windings of the ignition coil by exciting the primary windings of the ignition coil with the high voltage charged in the capacitor. As set forth above, applying this system to the two cylinder simultaneous ignition type ignition system, in which two ignition coils connected to the spark plugs of two cylinders forming a pair of the compression stroke and exhaust stroke, the above problem in that the voltage generated in the secondary winding may be lowered at the high speed range of the internal combustion engine for prolongation of the excitation period for the primary windings, can be avoided. Therefore, the high voltage can be quickly generated on the secondary winding.

However, even in such capacitive discharge type ignition system, it is required substantially higher energy for simultaneously exciting the primary windings of two ignition plugs connected in series, than that for exciting the primary winding of a single spark plug as disclosed by Morino et al in U.S. Pat. No. 5,056,496. Occasionally, it may be required double of energy to that in the case where the primary winding of the single spark plug, as in the induction discharge type.

SUMMARY OF THE INVENTION

In view of the problems set forth above, it is an object of the present invention to generate a high voltage on secondary windings of spark plugs by excitation in a short period and to reduce an energy for excitation by connecting primary windings of two ignition coils connected to spark plugs of two engine cylinders forming a pair of compression stroke and exhaust stroke.

In order to accomplish the above-mentioned object, an ignition system for an internal combustion engine according to the present invention comprises:

- a plurality of ignition coils provided in each engine cylinder and connected to spark plugs respectively;
- an ignition circuit connecting in series primary windings of two ignition coils connected to spark plugs of two engine cylinders forming a pair of compression stroke and exhaust stroke, connecting an energy accumulating means for accumulating excitation energy to one end of a series circuit of the primary windings, and connecting switching elements for excitation to the other end of said series circuit of said primary windings;
- charging means for charging the excitation energy to said energy accumulating means; and
- an ignition means for making said switching elements conductive at a predetermined ignition timing to provide a current to two primary windings connected in series with the excitation energy accumulated in said energy accumulating means for generating high voltage at secondary windings of said two ignition coils.

In addition, the ignition system of the invention features in that a coupling coefficient between the primary winding and the secondary winding in each ignition coil is set to be greater than or equal to 0.9.

In the ignition system for the internal combustion engine of the present invention, the charging circuit charges the excitation energy to the energy accumulating means, the ignition means makes the switching elements conductive at predetermined ignition timing, and the energy accumulating means applies the current to two primary windings with the excitation energy accumulated in the energy accumulating means to generate the high voltage on the secondary windings, and to effect arcing discharge in the spark plugs of the engine cylinders in the compression means and exhaust means.

Therefore, in the ignition system according to the present invention, high voltage for ignition can be instantly generated on the secondary winding by excitation of the primary winding similarly to the abovementioned capacitive discharge type ignition system which accumulates the excitation energy in the capacitor. Therefore, even at a high speed range of the internal combustion engine, necessary high voltage can be applied to the spark plug for certainly firing the air/fuel mixture in the engine cylinder in the compression stroke.

On the other hand, the ignition coils connected to respective spark plugs of respective engine cylinders are set with the coupling coefficient greater than or equal to 0.9 between the primary windings and the secondary windings. Therefore, the energy to be provided for the ignition circuit is not necessary to increase significantly in comparison with the case where the primary winding for the single spark plug is employed. For instance, the high voltage for ignition can be generated on the secondary windings for ignition with the excitation energy of approximately 1.1~1.2 times of the case where the primary winding for the single spark plug is employed.

The inventors has confirmed through experiments the effect of the coupling coefficient on the generated secondary voltage generated by the secondary winding.

DESCRIPTION OF THE PREFERRED EMBODIMENTS

The preferred embodiments of the present invention will be discussed hereinafter with reference to the drawings.

Figure 1:
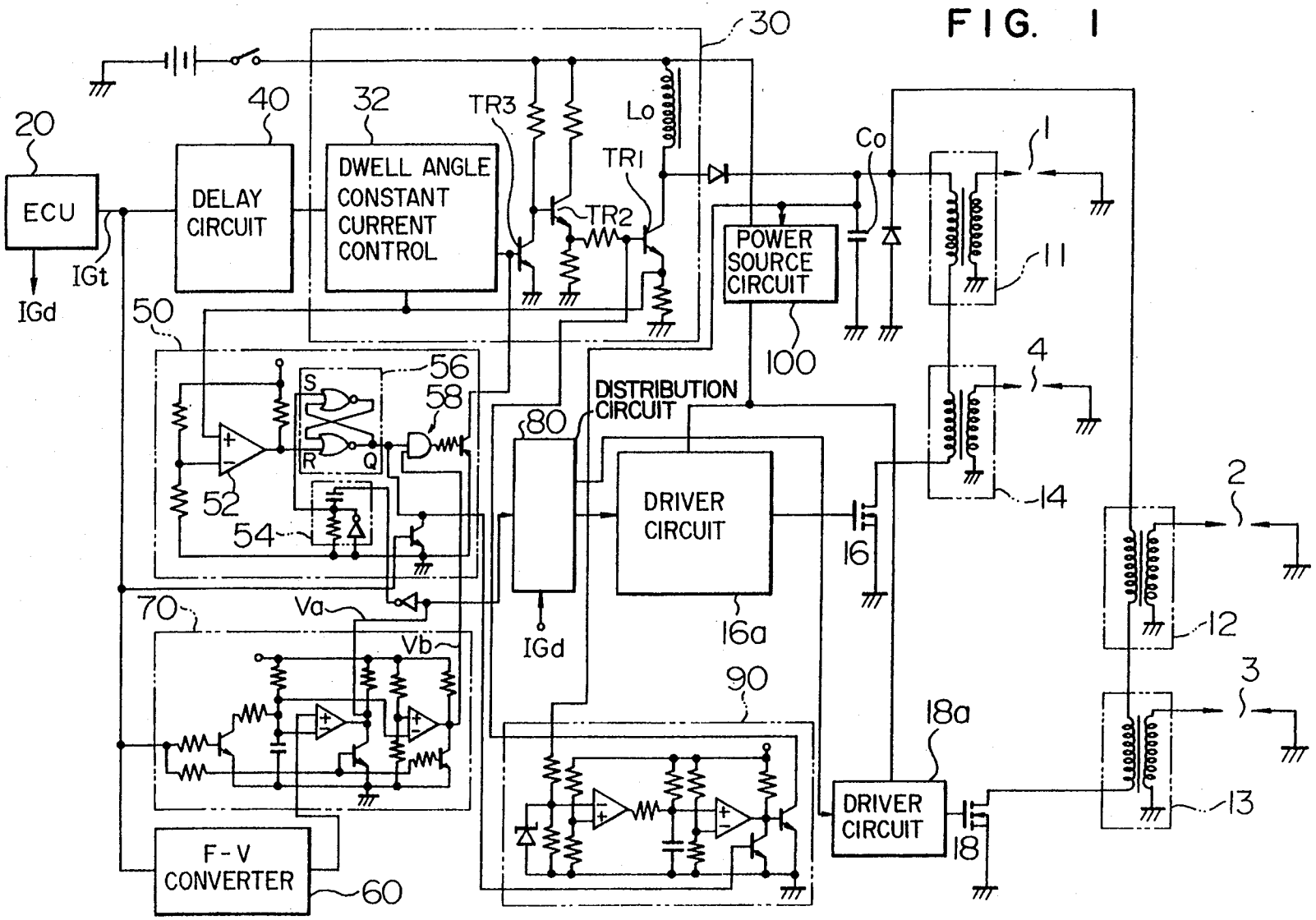
FIG. 1 is a schematic block diagram showing an overall construction of an embodiment of an ignition system of the invention for a four cylinder internal combustion engine.

FIG. 1 is a schematic block diagram showing an overall construction of an embodiment of an ignition system for a four cylinder internal combustion engine.

As shown in FIG. 1, the shown embodiment of an ignition system has four ignition coils 11~14 having secondary windings connected to spark plugs 1~4 provided in respective cylinders of an internal combustion engine. Each two cylinders are selected in pairs having a relationship that when one is in a compression stroke, the other is in an exhaust stroke and vice versa. In the shown embodiment of the ignition system, two primary windings of the ignition coils connected to the spark plugs of the cylinders working in pairs, one in the compression stroke and the other in the exhaust stroke, among four ignition coils 11~14, are connected in series. Namely, the primary windings of the ignition coils 11 and 14 connected to the spark plugs 1 and 4 of the #1 cylinder and #4 cylinder respectively, and the primary windings of the ignition coils 12 and 13 connected to the spark plugs 2 and 3 of the #2 cylinder and #3 cylinder respectively are connected in series, respectively. On the other hand, one ends of the two series circuits, in which the primary windings of the ignition coils 11 and 14 are connected in series and the primary windings of the ignition coils 12 and 13 are connected in series, are both connected to a common energy accumulating capacitor $C_0$ for accumulating an excitation energy for exciting both of the series circuits. Also, the other ends of the series circuits are respectively connected to switching elements 16 and 18 which comprise metal oxide semiconductor (MOS) type field effect transistors (FET) for switching exciting and interrupting the series circuits. These ignition coils have constructions to have coupling coefficients greater than or equal to 0.9. It should be noted that an energy accumulating capacitor $C_0$ may be provided for each series circuit.

The shown embodiment of the ignition system includes drive circuits **16*a* and 18*a* for respectively driving the switching elements 16 and 18 for controlling a spark ignition timing, a known electronic control unit (ECU) for deriving the spark ignition timing depending upon an engine operating condition for generating a spark ignition signal $IG_t$ and a distribution signal $IG_d$ for selecting the cylinder to effect ignition, an energy accumulation circuit 30 responsive to the spark ignition signal $IG_t$ for accumulating energy in an energy accumulating coil $L_0$, a delay circuit 40 for providing a delay for the spark ignition signal $IG_t$ from the ECU 20 to input the energy accumulation circuit 30, a capacitor charging control circuit 50 for charging an energy accumulating capacitor $C_0$ with the energy accumulated in the energy accumulation circuit 30, an F-V converter 60 for generating a voltage signal inversely proportional to an output frequency (an engine speed of the internal combustion engine) of the spark ignition signal $IG_t$ from the ECU 20, a monostable circuit 70 for outputting a signal Va having a predetermined pulse width (about 1 msec.) and a signal Vb having a predetermined pulse width (about 10 msec.) from falling edge of the spark ignition signal $IG_t$ corresponding to the output voltage of the F-V converter 60, a distribution circuit 80 receiving the output pulse Va from the monostable circuit 70 for outputting a drive signal to the driver circuit 16*a* or 18*a* corresponding to the distribution signal $IG_d$, a timing control circuit 90 for detecting charge voltage of the energy accumulation capacitor $C_0$ and controls exciting timing of the energy accumulating coil $L_0$ in the energy accumulation circuit 30 and conduction timing of the switching elements 16 and 18, and a power source circuit 100** receiving a battery voltage for generating a power source voltage VCC to be supplied to respective portions.

The energy accumulation circuit 30 has the energy accumulating coil $L_0$ which is formed with the typical inductive discharge type ignition coil excluding the secondary winding and remaining are identical to those of the conventional inductive discharge type ignition system.

The energy accumulation circuit 30 comprises a power transistor TR1 for switching excitation and interrupting of the energy accumulating coil $L_0$, a known dwell angle/constant current control circuit 32 for switching the power transistor TR1 into conductive state by the spark ignition signal $IG_t$ input via the delay circuit 40, through transistors TR2 and TR3 and limiting the current flowing through the energy accumulating coil $L_0$ via the power transistor TR1 in the conductive state. Upon turning off of the power transistor TR1, the energy accumulated in the energy accumulating coil $L_0$ is output to the energy accumulating capacitor $C_0$. The dwell angle/constant current control circuit 32 maintains the power transistor TR1 in conductive state to accumulate the energy by exciting the energy accumulating coil $L_0$ and turns off the power transistor TR1 in response to the falling edge of the spark ignition signal $IG_t$ to output the energy accumulated in the energy accumulating coil $L_0$ to the energy accumulating capacitor $C_0$.

The capacitor charging control circuit 50 comprises a comparator 52 for making judgement whether the exciting current in the energy accumulating coil $L_0$ reaches a predetermined current magnitude or not and outputting a judgement signal when the exciting current reaches the predetermined current magnitude, a differentiation circuit 54 for differentiating an inverted signal of the pulse signal Va output from the monostable circuit 70, an RS flip-flop 56 to be set by the output signal (i.e. the falling edge of the pulse signal Va) from the differentiation circuit 54 and reset by the judgement signal from the comparator 52, and an output circuit 58 for switching the power transistor TR1 of the energy accumulating circuit 30 into conductive state to excite the energy accumulating coil $L_0$ when the pulse signal Vb is output from the monostable circuit 70 while the RS flip-flop 56 is set.

Namely, the capacitor charging control circuit 50 excites the energy accumulating coil $L_0$ after elapsing of a period corresponding to period from falling edge of the spark ignition signal $IG_t$ to the pulse width of the pulse signal Va (i.e. the given period corresponding to the engine speed of the internal combustion engine), and outputs the energy accumulated in the energy accumulating coil $L_0$ to the energy accumulating capacitor $C_0$.

In the shown embodiment of the ignition system constructed as set forth above, while the spark ignition signal $IG_t$ is not output from the ECU 20, the power transistor TR1 is held on by the capacitor charging control circuit 50 to accumulate the predetermined magnitude of energy in the energy accumulating coil $L_0$, and, subsequently, by turning off of the power transistor TR1, to charge the energy in the energy accumulating capacitor $C_0$ by the accumulated energy.

The power transistor TR1 is held on operated by the dwell angle/constant current control circuit 32 while the spark ignition signal $IG_t$ is output from the ECU 20 to accumulate up to a predetermined energy in the energy accumulating coil $L_0$, and, subsequently, by turning off of the power transistor TR1, to charge the energy accumulating capacitor $C_0$ by the accumulated energy.

Upon falling down of the spark ignition signal $IG_t$, the distribution circuit 80 drives one of the driver circuits **16*a* and 18*a* corresponding to the distribution signal $IG_d$ on the basis of the pulse signal Va output from the monostable circuit 70 to make one of the switching element 16 or 18 conductive. Therefore, the energy output from the energy accumulation circuit 30 in response to falling down of the spark ignition signal $IG_t$, is transferred to the primary windings of the ignition coils 11 and 14 or to the primary windings of the ignition coils 12 and 13** together with the energy charged in the energy accumulating capacitor $C_0$.

Subsequently, in response to falling down of the pulse signal Va output from the monostable circuit 70, the driver circuit **16*a* or 18*a* terminates operation, and the switching element 16 or 18 turns on. Then, the energy accumulated in the primary windings of the ignition coils 11 and 14 or the primary windings of the ignition coils 12 and 13 is discharged to the spark plugs 1 and 4 or the ingnition plugs 2 and 3** via the secondary windings to effect spark ignition.

Namely, in the shown embodiment of the ignition system, the energy accumulating capacitor $C_0$ and the energy accumulating coil $L_0$ serve as an energy accumulating means so that the primary windings of the ignition coils 11 and 14 or the primary windings of the ignition coils 12 and 13 are excited by the excitation energy accumulated in the energy accumulating capacitor $C_0$ and the energy accumulating coil $L_0$. By excitation, a high voltage is instantly charged to the corresponding pair of the spark plugs 1 and 4 or the spark plugs 2 and 3.

It should be noted that the timing control circuit 90 is adapted to provide a timing difference between off timing of the power transistor TR1 and on timing of the switching elements 16 and 18 so that the on timing of the switching elements 16 and 18 is slightly earlier than the off timing of the power transistor TR1.

Although the control system in the shown embodiment of the ignition system is briefly discussed, such control system is similar to that disclosed in the commonly owned U.S. Pat. No. 4,892,080 (corresponding to Japanese Unexamined Patent Publication JP-A-1-232165). The disclosure in the above-identified U.S. Patent is herein incorporated by reference.

In the shown embodiment of the ignition system, by exciting the ignition coil with the excitation energy accumulated in the energy accumulating capacitor $C_0$ and the energy accumulating coil $L_0$ respectively, high voltage can be instantly charged to the spark plugs. However, in such ignition system, larger energy is generally required for simultaneously exciting primary windings of two series connected ignition coils (11 and 14 or 12 and 13) to generate high ignition voltage in the secondary windings than that for exciting the primary winding in a single ignition coil, similarly to the conventional capacitive discharge type ignition system. Occasionally, it may require the excitation energy double of the case where the primary winding for the single ignition coil is to be excited as in the inductive discharge type ignition system.

Therefore, in the shown embodiment, in order to reduce the excitation energy to be accumulated in the energy accumulating capacitor $C_0$ and the energy accumulating coil $L_0$, the coupling coefficient k between the primary and secondary windings in the ignition coils 11~14 is set to be greater than or equal to 0.9 based on the experiments performed by the inventors.

Figure 2:
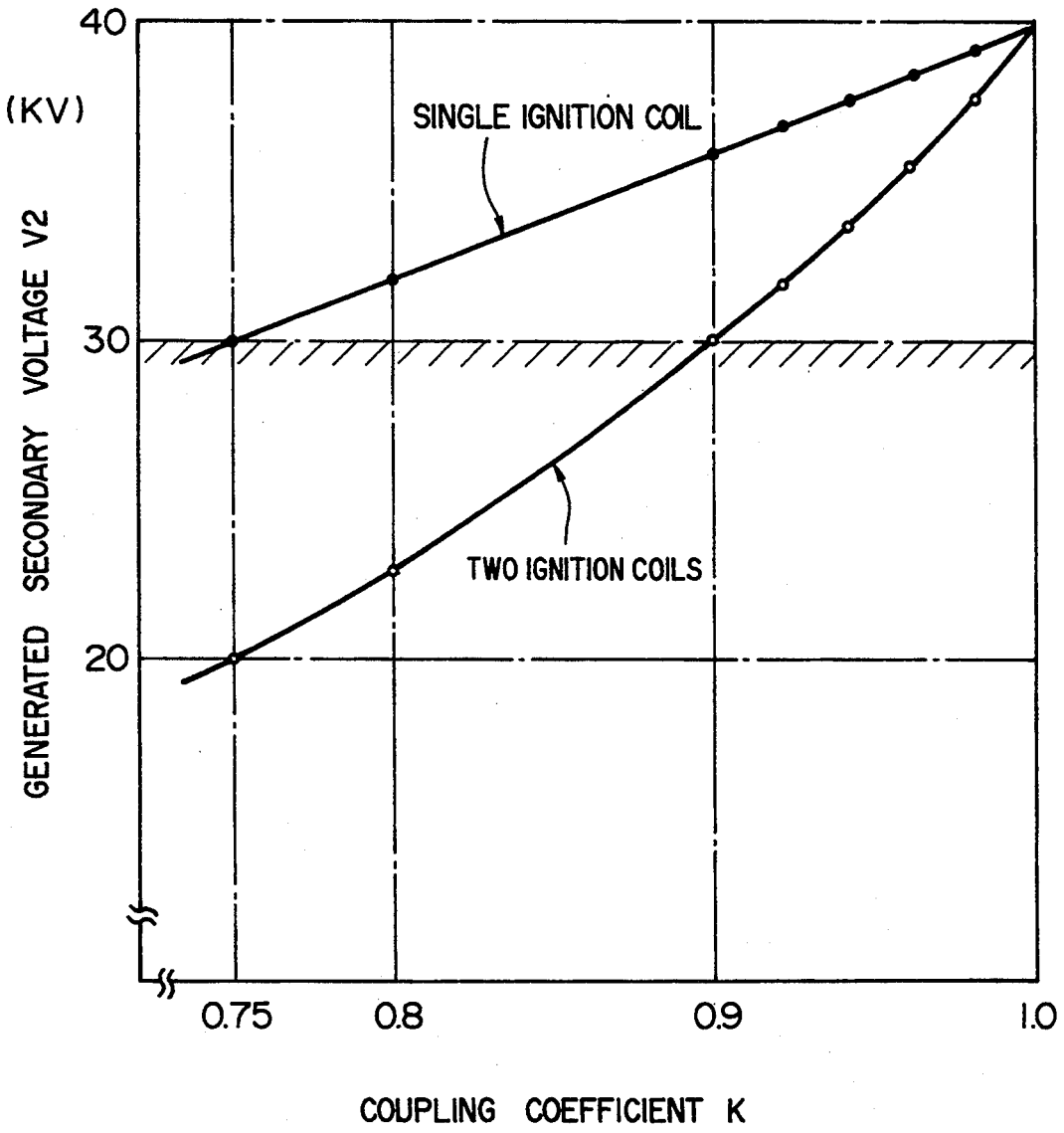
FIG. 2 is an explanatory illustration showing a relationship between a coupling coefficient and a secondary generated voltage.

FIG. 2 shows results of the experiments for relationship between the coupling coefficients k of the ignition coils and the generated secondary voltage $V_2$ at a constant input energy for respective cases of the single ignition coil and the series connected two ignition coils. As apparent from the results of experiments, in comparison with the case of the single ignition coil, the generated secondary voltage $V_2$ is abruptly lowered according to lowering of the coupling coefficient k when the two ignition coils are connected in series. The generated secondary voltage $V_2$ exceeds 30 KV when the coupling coefficient is 0.9 in case of two ignition coils while the coupling coefficient is 0.75 in case of the single ignition coil. Therefore, in the shown embodiment, in view of the results of experiments of FIG. 2, the coupling coefficient k of the ignition coils 11~14 is set to be greater than or equal to 0.9 for obtaining the generated secondary voltage $V_2$ exceeding necessary 30 KV without causing substantial increase of the excitation energy. Thus, the sufficient magnitude of the generated secondary voltage can be certainly obtained.

It should be noted that the reason of greater influence of the coupling coefficient of the ignition coil to the series connected two ignition coils while being excited in comparison with the single ignition coil is deemed as follows.

Figure 3A:
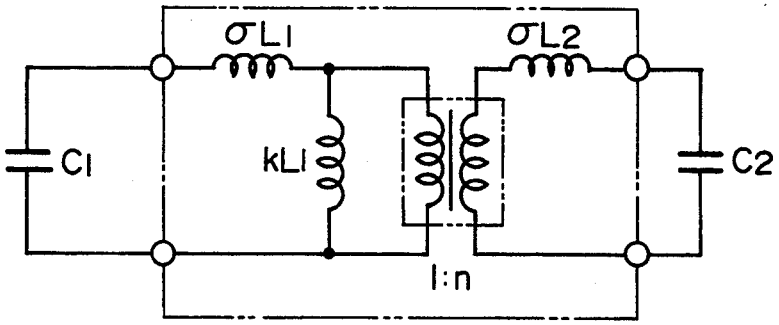
FIG. 3A is an illustration of an equivalent circuit of the ignition system having one ignition coil.

At first, the shown embodiment of the ignition system constructed as set forth above is considered to be similar to the typical capacitive discharge type ignition system, and the equivalent circuit for exciting the single ignition coil can be illustrated as shown in FIG. 3A. Then, the generated secondary voltage $V_2$ generated in the secondary side of the ignition coil can be expressed by the following equation (1):

$$V_2=2\cdot k\cdot n\cdot Vc/(1+n^2\cdot C_2/C_1) \quad (1)$$

where k: coupling coefficient;

$\sigma$: leakage ratio (1−k)

n: turn ratio $V_c$: voltage applied to the capacitor in the primary side $C_1$: capacity of the capacitor in the primary side $C_2$: capacity of the capacitor in the secondary side (=distributed capacity of the secondary side including the spark plug)

As can be appreciated, in case of the single ignition coil, the generated secondary voltage $V_2$ is proportional to the coupling coefficient k of the ignition coil in simple manner. Therefore, the generated secondary voltage $V_2$ has relatively low sensitivity for the influence of the coupling coefficient k.

Next, consideration is given for the case where the primary sides of ignition coils are connected in series.

The cylinder in the exhaust stroke has lower internal pressure in comparison with the cylinder in the compression stroke so that discharge may be easily caused. Therefore, upon spark ignition in the cylinder in the compression stroke, the secondary side of the ignition coil for the cylinder in the exhaust stroke is regarded to be shorted. Also, a secondary side leakage inductance $\sigma L_2$ can be expressed as $\sigma n^2 L_1$ employing the primary side inductance $\sigma L_1$. This can be converted to the primary side as $\sigma L_1(=\sigma n^2 L_1/n^2)$. Therefore, the equivalent circuit when leakage inductance in the secondary side of the ignition coil of the exhaust stoke side is converted into the primary side, can be illustrated as shown in FIG. 3B.

Figure 3B:
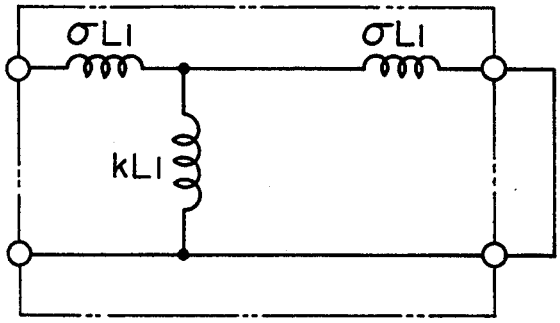
FIG. 3B is an illustration of an equivalent circuit of an ignition coil in an exhaust stroke.
Figure 3C:
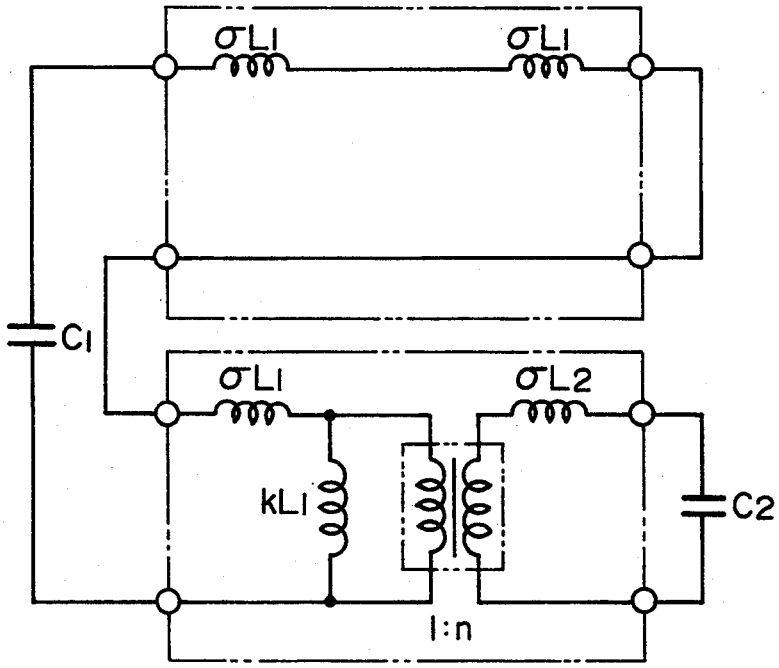
FIG. 3C is an illustration of an equivalent circuit of an ignition circuit, in which two ignition coils are connected in series.

Accordingly, the equivalent circuit for the case where two ignition coils are connected in series can be illustrated as shown in FIG. 3C utilizing the equivalent circuit of FIG. 3B. Comparing the equivalent circuit of FIG. 3C with the equivalent circuit of FIG. 3A, it can be appreciated that when two ignition coils are connected in series, the primary side leakage inductance $\sigma L_1$ becomes $3\times\sigma L_1$.

Therefore, the coupling coefficient k' when two ignition coils are connected in series can be given by:

$$\begin{aligned} k' &= \{(1+2\sigma)-3\sigma\}/(1+2\sigma) \\ &= (1-\sigma)/(1+2\sigma) \\ &= k/(3-2k) \end{aligned} \quad (2)$$

Thus, in comparison with the case where the single ignition coil is connected, the influence of the coupling coefficient k to the generated secondary voltage $V_2$ becomes greater.

As set forth above, in the shown embodiment of the ignition system for the internal combustion engine, by connected in series the primary windings of the ignition coils connected to the spark plugs of the cylinders establishing a pair of compression stroke and exhaust stroke, and by transferring the excitation energy accumulated in the energy accumulating capacitor $C_0$ and the energy accumulating coil $L_0$ at the given ignition timing, high voltage is instantly applied to the spark plugs. Therefore, even at high speed range of the internal combustion engine, necessary high voltage for ignition can be charged to the spark plug for certainly firing an air/fuel mixture in the cylinder in the compression stroke.

Also, since the coupling coefficient k of the ignition coils 11–14 is set to be greater than or equal to 0.9, it becomes unnecessary to significantly increase the excitation energy to be accumulated in the energy accumulating capacitor $C_0$ and the energy accumulating coil $L_0$ as the energy accumulating means, in comparison with the case of the single ignition coil being connected so that the high voltage for ignition can be generated with the excitation energy of approximately 1.1~1.2 times of that required in the case where the single ignition coil is connected.

Figure 4A:
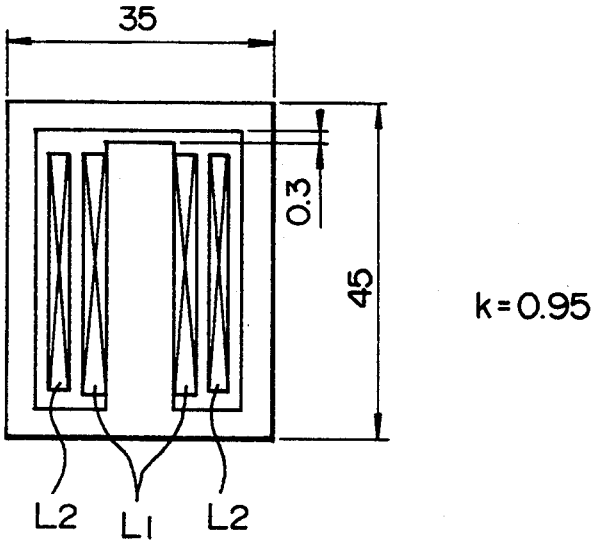
FIG. 4A is an illustration showing one example of a coil construction having a coupling coefficient of 0.95.
Figure 4B:
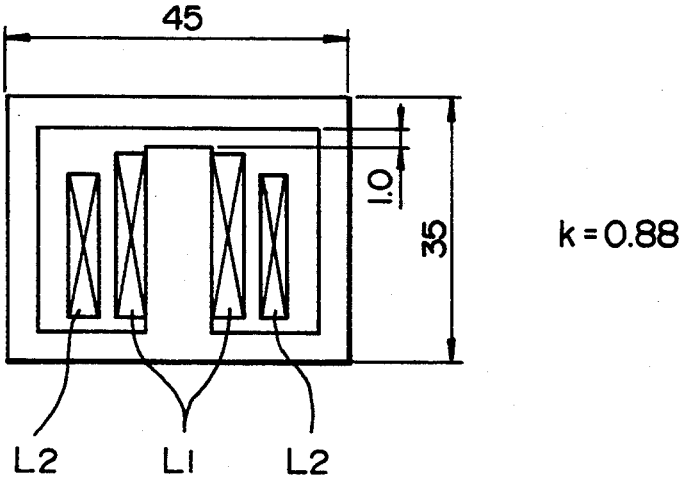
FIG. 4B is an illustration showing one example of a coil construction having a coupling coefficient of 0.88.

It should be noted that the ignition coil with the coupling coefficient k to be greater than or equal to 0.9 may be realized with a closed magnetic path structure and by adjustment of the gap and winding manner of the primary and secondary windings. For instance, as shown in FIG. 4B, in case of the ignition coil, in which a center core is provided in the vertical direction through an outer peripheral core of 35 mm in height and 45 mm in width, a gap between the center core and the outer peripheral core is 1.0 mm, and the primary winding $L_1$ and the secondary winding $L_2$ are wound on the center core in order, the coupling coefficient k becomes 0.88 and thus cannot satisfy the foregoing condition. However, as shown in FIG. 4A, by providing the center core in the longitudinal direction (namely width direction) in the outer peripheral core of 35 mm in height and 45 mm in width, providing the gap of 0.3 mm between the center core and the outer peripheral core, and by winding the primary winding $L_1$ and the secondary winding $L_2$ in order on the center core, 0.95 of the coupling coefficient k can be achieved.

Although the ignition system which once accumulates the excitation energy by means of the energy accumulating capacitor $C_0$ and coil $L_0$, and then excites the ignition coil, has been discussed as the embodiment of the present invention, the present invention is applicable for the typical capacitive discharge type ignition system which excites the ignition coil by accumulating the excitation energy only in the capacitor or for the ignition system of the type, in which the ignition coil is excited by once accumulating the excitation energy in the energy accumulating coil.

As set forth above, according to the ignition system of the present invention, by connecting in series the primary windings of the ignition coils connected to the spark plugs of the cylinders forming a pair of the compression stroke and the exhaust stroke, by applying the current to the series connected two primary windings with the excitation energy accumulated in the energy accumulating means for generating the high voltage for ignition on the secondary windings, the excitation period of the ignition coil can be shortened in comparison with the conventional inductive discharge type ignition system. Therefore, even at the high speed range of the internal combustion engine, necessary high voltage for ignition can be charged to the spark plug to certainly fire the air/fuel mixture in the cylinder in the compression stroke. Also, since the coupling coefficient k of the ignition coil is set to be greater than or equal to 0.9, it becomes unnecessary to significantly increase the excitation energy to be accumulated in the energy accumulating means, in comparison with the case where the single ignition coil is connected. For instance, the high voltage for ignition can be generated with the excitation energy of approximately 1.1~1.2 times of the case where the single ignition coil is connected.

What is claimed is:

1. An ignition system for an internal combustion engine including an even number of spark plugs, comprising:

a plurality of ignition coils, each having a primary winding and a secondary winding, said secondary winding being connected to a spark plug;

at least one direct current circuit including switching elements for controlling current flow in said circuit and connecting in series said primary windings of a pair of ignition coils respectively having secondary windings connected to spark plugs of two engine cylinders working in pairs one in a compression stroke while the other in an exhaust stroke among said plurality of ignition coils, and said switching elements;

energy accumulating means connected to one end of said direct current circuit for accumulating an excitation energy for said ignition coils;

charging means for charging the excitation energy to said energy accumulating means; and ignition means for applying current for said primary windings of two ignition coils connected in series with said energy accumulating means by making said switching elements conductive at a given ignition timing for simultaneously generating a high voltage at said secondary windings of said ignition coils, wherein said ignition coils have a coupling coefficient of larger than or equal to 0.9 between said primary winding and said secondary winding.

2. An ignition system for an internal combustion engine as set forth in claim 1, wherein said energy accumulating means includes a capacitor connected in parallel to said direct current circuit and a coil connected in series to said direct current circuit.

3. An ignition system for an internal combustion engine as set forth in claim 1, wherein a plurality of said direct current circuits are provided, and said energy accumulating means is connected in common to said plurality of direct current circuits.

* * * * *